US005207624A

United States Patent [19]

Paskovich

[11] Patent Number: 5,207,624

[45] Date of Patent: May 4, 1993

[54] PIVOTED WEIGHT-LIFTING APPARATUS

[76] Inventor: Michael Paskovich, 5A Stillwell Rd., Kendall Park, N.J. 08824

[21] Appl. No.: 818,837

[22] Filed: Jan. 10, 1992

[51] Int. Cl.[5] ..... A63B 21/06

[52] U.S. Cl. ..... 482/93; 482/97; 482/106; 482/109

[58] Field of Search ..... 482/93, 97, 106, 108, 482/109

[56] References Cited

U.S. PATENT DOCUMENTS

| | | | |
|---|---|---|---|
| 3,010,720 | 11/1961 | Allard | 482/97 |
| 3,573,866 | 4/1971 | Madden | 482/97 |
| 3,690,655 | 9/1972 | Chapman | 482/109 |
| 4,252,316 | 2/1981 | Price | 482/106 |
| 4,607,840 | 8/1986 | Harper | 482/109 |
| 4,664,373 | 5/1987 | Hait | 482/93 |
| 4,708,340 | 11/1987 | D'Agosta | 482/109 X |

*Primary Examiner*—Robert Bahr

[57] ABSTRACT

A body exercising apparatus, in the form of a weight lifting apparatus, which includes an elongate lever arm having first and second opposite ends. The first end of the lever arm is capable of being anchored by means of wedging same into the corner of a room. The lever arm is capable of receiving conventional bar-bell type weights in selected amounts. A handle member is located at the second end of the lever arm for engagement by the hands of a user of the apparatus so that this user can attempt to lift the lever arm about the pivotal anchor point against one or more weights placed on the lever arm. The handle member is adjustably positionable with respect to the lever arm so as to accommodate the overall height of the user.

5 Claims, 1 Drawing Sheet

PIVOTED WEIGHT-LIFTING APPARATUS

BACKGROUND OF THE INVENTION

This invention relates in general to certain new and useful improvements in body exercising apparatus, and more particularly, to body exercising apparatus uniquely adaptable for relatively inexpensive employment and in which a user attempts to lift one or more weights selectively located on a standard Olympic weight bar or one inch standard weight bar by lifting one end of the lever arm while the other end is pivotally anchored in the corner of a room. In effect, utilization of the subject invention allows a weight lifter to create through the use of conventional weight lifting apparatus, what is known as a T-Bar Rower and which is ordinarily only found in professional gyms due to its prohibitively high cost.

BRIEF DESCRIPTION OF THE PRIOR ART

In recent years, there has been an increased awareness and interest in body exercising for purposes of health improvement and control. As a result thereof, there has been a large number of body exercising apparatus which has been introduced into the marketplace. One of the most common types of body exercising apparatus is that in which the user attempts to exert an upwardly directed force e.g. a lifting force against a weight, as for example one or more weights placed on a weight lifting bar. For example, the user of such exercising apparatus is required to exert an amount of force sufficient to overcome a vertical downward force vector imposed by a selected amount of weight placed on or introduced with respect to such apparatus. This weight exercising apparatus may adopt many forms in which the user may assume various positions for use as for example, a prone position, a generally upright position, or the like.

Heretofore, there has not been any commercially available body exercising apparatus employing the lifting force concepts which is generally available in a construction which is not mechanically complex and hence a construction available at a relatively low unit cost. Typically, each of the commercially available body exercising apparatus which involves the lifting of one or more selectively imposed weights are designed for commercial use in what is typically referred to as a "T-bar rower" for use in public gymnasiums and so called health establishments.

The instant invention capitalizes upon the well-known use of "bar bells" by body builders which utilize an elongate bar commonly known as an Olympic weight bar or one inch diameter standard bar with one or more generally circular weights mountable thereon. Through the use of the novel accessory handle member the aforesaid well-known bar bell apparatus is easily converted into an effective body exercising apparatus for emphasizing the lats and back muscles analogous to the commercially available "T-bar rower" found almost exclusively in public gymnasiums and so-called health establishments due to the exceedingly high cost associated therewith.

OBJECTS OF THE INVENTION

It is therefore a primary object of the present invention to provide a body exercising apparatus which simulates that of an exercising apparatus normally found in commercial body exercising institutes but which is provided in a construction and operated in a manner so that it is available at a relatively low cost and is capable of being afforded and used by private individuals such as home users.

It is another object of the present invention to provide a body exercising apparatus of the type stated which includes a single lever arm such as a conventional Olympic bar or one inch standard bar bell bar which is capable of being pivotally anchored in the corner of a room and where the lever arm is designed to carry weights selectively introduced by a user thereof.

It is a further object of the present invention to provide a body exercising apparatus of the type stated which affords all of the flexibility of a body exercising apparatus commonly known as a "T-bar rower" and which is normally found at commercial body exercising institutes but which is relatively available at a low cost and which is highly reliable in its operation.

It is also an object of the present invention to provide a body exercising apparatus of the type stated which includes a detachable adjustably positionable handle mechanism for engagement by a user thereof.

With the above and other objects in view, my invention resides in the novel features of form, construction, arrangement and combination of parts presently described and pointed out in the claims.

BRIEF DESCRIPTION OF THE DRAWINGS

Having best described the invention in general terms, reference will now be made to the accompanying drawings in which.

DETAILED DESCRIPTION OF PREFERRED EMBODIMENT

Figure 1:
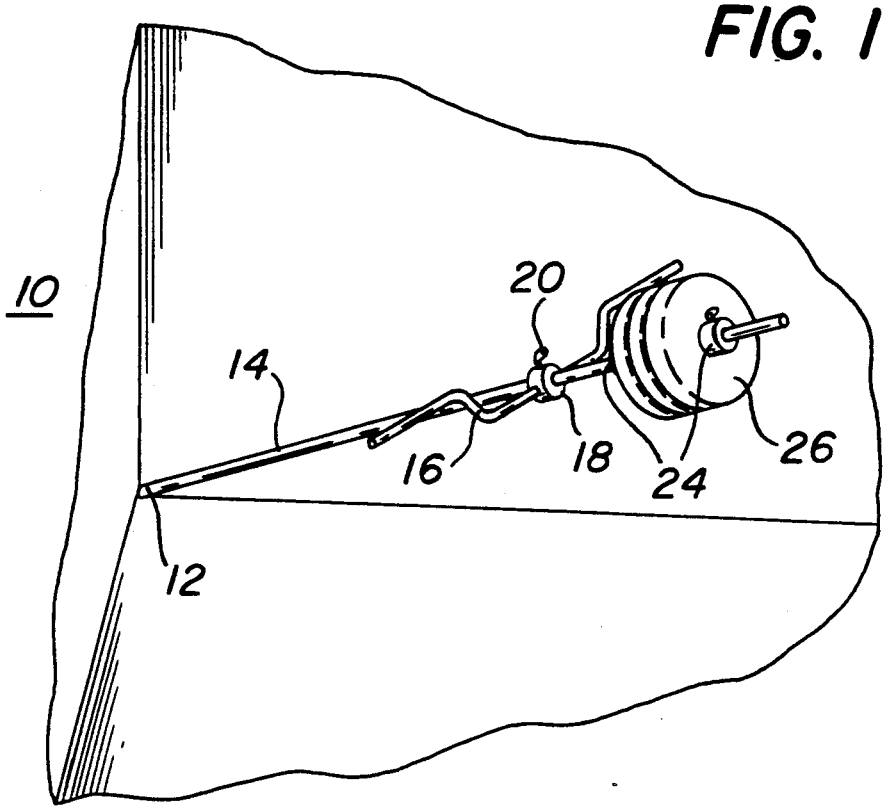
FIG. 1 is a perspective view of a weight lifting body exercising apparatus constructed in accordance with and embodying the present invention.
Figure 2:
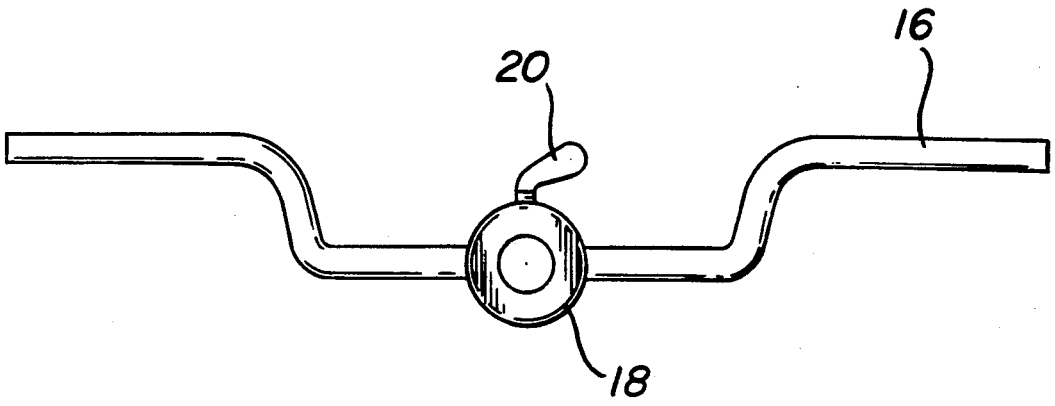
FIG. 2 is a perspective view of the detachable adjustably positionable handle mechanism embodied in the present invention.

Referring now in more detail and by reference characters to the drawings which illustrate certain practical embodiments of the present invention, the body exercising apparatus which relies upon a construction utilizing conventional bar bell bars and weights is more fully illustrated in FIGS. 1 and 2 of the drawings.

Shown thereon is a lever arm 14 which may be a conventional Olympic-type bar bell bar or a conventional one inch bar bell type bar, one end of which is pivotally anchored by wedging same in the corner 12 of any typical exercise room 10. At the other end of lever arm 14 is detachably mounted a handle member 16 for engagement by the hands of the user of the apparatus so that this user can attempt to lift the lever arm about the pivotal anchor point 12 against one or more bar bell type weights 26 placed on the lever arm 14. Weights 26 are retained in place on lever arm 14 by means of detachably mounted collars 24. Handle member 16 is further comprised of a metal collar 18 and locking means 20 for purposes of securing and adjusting same to accommodate the overall height of the user.

To use this machine, the exerciser straddles lever arm 14 in a standing position and engages handle member 16 by bending at the knees. Lever arm 14 with attached weights 24 is then lifted by means of handle member 16 after which this entire assembly is raised and lowered in repetitive fashion in order to achieve muscle buildup in the shoulder and back areas, known as the trapezius and latissimus dorsi muscle groups.

It is noted that in the early stages of working with this exercise device, the closer the weights 26 are placed to anchored end 12 of lever arm 14, the easier it is to operate and conversely the farther away it is placed the harder it is to raise and lower the lever arm 14. Accordingly, the adjustable weights 26 may be placed at the appropriate and desired position to give the desired resistance to exercise activity.

In an alternative embodiment, weights 26 are retained in place without collars 24 and simply rest against handle member collar 18.

It is believed that the exercise device of this invention is the most complete, simplified and streamlined exercise device of its type. It involves a minimum of parts but provides a maximum exercise result.

Some changes may be made in the construction and arrangement of this exercise device without departing from the real spirit and purpose of the invention. Although this description has been made in detail, various modifications can be made thereto without departing from the spirit or scope of the invention.

Having best described my invention, what I desire to claim and secure by letters patent is:

1. A body exercising apparatus comprising:

a lever arm having a first free end and a second opposite end capable of being anchored;

at least one weight disc having a central aperture therein, said at least one weight disc mounted on said lever arm through said aperture so that said at least one weight disc is carried by and movable with said lever arm;

handle means detachably secured to said lever arm toward said free end of said lever arm between said at least one weight disc and said second end for engagement by the hands of a user of said body exercising apparatus said lever arm being free of structures proximate said second end such that a user may anchor the second end and attempt to lift the lever arm pivotally with respect to its anchor point against said at least one weight disc said handle means extending perpendicularly to said lever arm and having a pair of straight gripping portion on opposite sides of said lever arm, said straight gripping portions defining a single line offset from said lever arm, said handle means further being manually adjustable so that the height of said handle means is adjustable so that the height of said handle means is adjustably positionable relative to said ever arm; and weight retaining means on said lever arm for removably retaining said at least one weight disc said weight retaining means and said at least one weight located between said handle means and the free end of said lever arm.

2. The body exercising apparatus of claim 1 further characterized in that the lever arm is a conventional bar bell type bar.

3. The body exercising apparatus of claim 2 further characterized in that said weight retaining means comprise detachably mounted collars.

4. The body exercising apparatus of claim 3 further characterized in that said handle means is detachably secured to said lever arm by means of a metal collar and locking means.

5. The body exercising apparatus of claim 4 further characterized in that said weight disc comprises-barbell-type weights.

* * * * *